US007156270B2

(12) United States Patent
Chen

(10) Patent No.: US 7,156,270 B2
(45) Date of Patent: Jan. 2, 2007

(54) STACKABLE GARMENT HANGER

(76) Inventor: Jack Chen, 3773 Fox Pointe, Rockford, IL (US) 61114

( * ) Notice: Subject to any disclaimer, the term of this patent is extended or adjusted under 35 U.S.C. 154(b) by 439 days.

(21) Appl. No.: 10/754,813

(22) Filed: Jan. 9, 2004

(65) Prior Publication Data

US 2004/0144812 A1 Jul. 29, 2004

Related U.S. Application Data

(60) Provisional application No. 60/438,961, filed on Jan. 9, 2003.

(51) Int. Cl.
*A41D 27/22* (2006.01)

(52) U.S. Cl. ..... 223/88

(58) Field of Classification Search ..... 223/85–98
See application file for complete search history.

(56) References Cited

U.S. PATENT DOCUMENTS 4,129,218 A * 12/1978 Koellner ..... 211/116
4,638,931 A * 1/1987 Rieser ..... 223/88
5,038,979 A * 8/1991 Traylor ..... 223/88
5,894,969 A * 4/1999 Speckert ..... 223/85
5,971,237 A * 10/1999 Timbrook ..... 223/85
6,041,985 A * 3/2000 Balser ..... 223/91
6,105,834 A * 8/2000 Cohen ..... 223/88
6,209,763 B1 * 4/2001 Rahmey ..... 223/88

* cited by examiner

*Primary Examiner*—Shaun R. Hurley
(74) *Attorney, Agent, or Firm*—Leydig, Voit & Mayer, Ltd.

(57) ABSTRACT

A hanger designed with hook member having a loop section is presented. The loop section, which is shaped in forms including a triangular shape, a rectangular shape, a circular shape and the like, allows other hanger hooks to be placed in the shape (e.g., triangular shape, circular shape). The frame can be made of wood or plastic material. With this new design, hangers can be stacked to utilize vertical space when needed.

23 Claims, 9 Drawing Sheets

STACKABLE GARMENT HANGER

CROSS-REFERENCE TO RELATED PATENT APPLICATIONS

This patent application claims the benefit of U.S. Provisional Patent Application No. 60/438,961, filed Jan. 9, 2003.

FIELD OF THE INVENTION

This invention pertains to garment or clothes hangers, and more particularly relates to hangers that can be stacked on other hangers.

BACKGROUND OF THE INVENTION

With conventional clothes hangers, there exists the problem that hangers cannot easily be stacked vertically to reduce space for storing clothes and to allows more garments to be carried by a person at a time. To combat this and other problems, some plastic hangers have been developed with small hooks near the base of the neck to hook onto other hangers.

While these devices fulfill their respective, particular objectives and requirements, the devices are not without their drawbacks. For example, a slight bump of many such hangers causes the hangers to come apart, defeating the purpose of such hangers. Additionally, the hooks often get tangled up with shirt collars. Accordingly, the present invention discloses a new garment hanger that allows hangers to remain together until removed by a user and that is simple and easy to use.

BRIEF SUMMARY OF THE INVENTION

The invention provides a hanger with a hook member having a loop in the neck section. The loop portion is at a 90 degree to the hook surface and the loop can be a circular shape, a triangular shape, a rectangular shape, etc. The hanger generally comprises a frame and a hook member. The frame includes two arms projecting outwardly to define opposing outer ends of the frame. The hook member extends upwardly from the frame. The loop section is between the hook portion of the hook member and the frame.

According to more detailed aspects of the invention, the frame is preferably made of wood or plastic, while the hook member is preferably made of wire or plastic. The triangular section is sized such that a hook portion of another hanger is easily placed in the triangular section while not taking up too much horizontal space.

In another embodiment of the invention, the hook member has a circular shaped neck section. The circular shaped neck section allows a multitude of hangers to be placed in the "circle."

These and other advantages of the invention, as well as additional inventive features, will be apparent from the description of the invention provided herein.

Figure 1A:
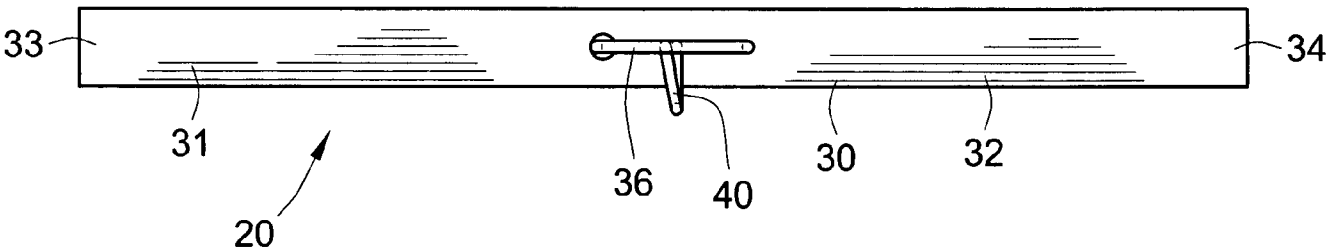
FIGS. 1*a*, 1*b*, and 1*c* depict front, top, and cross-sectional views of the hanger assembly constructed in accordance with the teachings of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The invention provides a garment hanger that allows hangers to remain together until removed by a user that is simple and easy to use. The garment hangers can be stacked together without getting tangled up with garments hung on the hangers.

Turning now to the drawings, like reference numerals refer to like elements. FIG. 1 illustrates a hanger assembly 20 constructed according to the teachings of the present invention. The frame 30 generally includes two arms 31, 32 projecting outwardly from the center of the frame to define opposing outer ends 33, 34 of the frame. A hook member 36 is attached to the center of the frame 30 for attaching the hanger to a rod or other support. The frame 30 is preferably constructed of wood, although it will be appreciated that any material such as metal or plastic can be used. The arms 31, 32 have been illustrated as extending downwardly and outwardly in a generally straight configuration, although it will be recognized that the arms may be of any size, configuration or cross-sectional shape as is known in the art.

Figure 3:
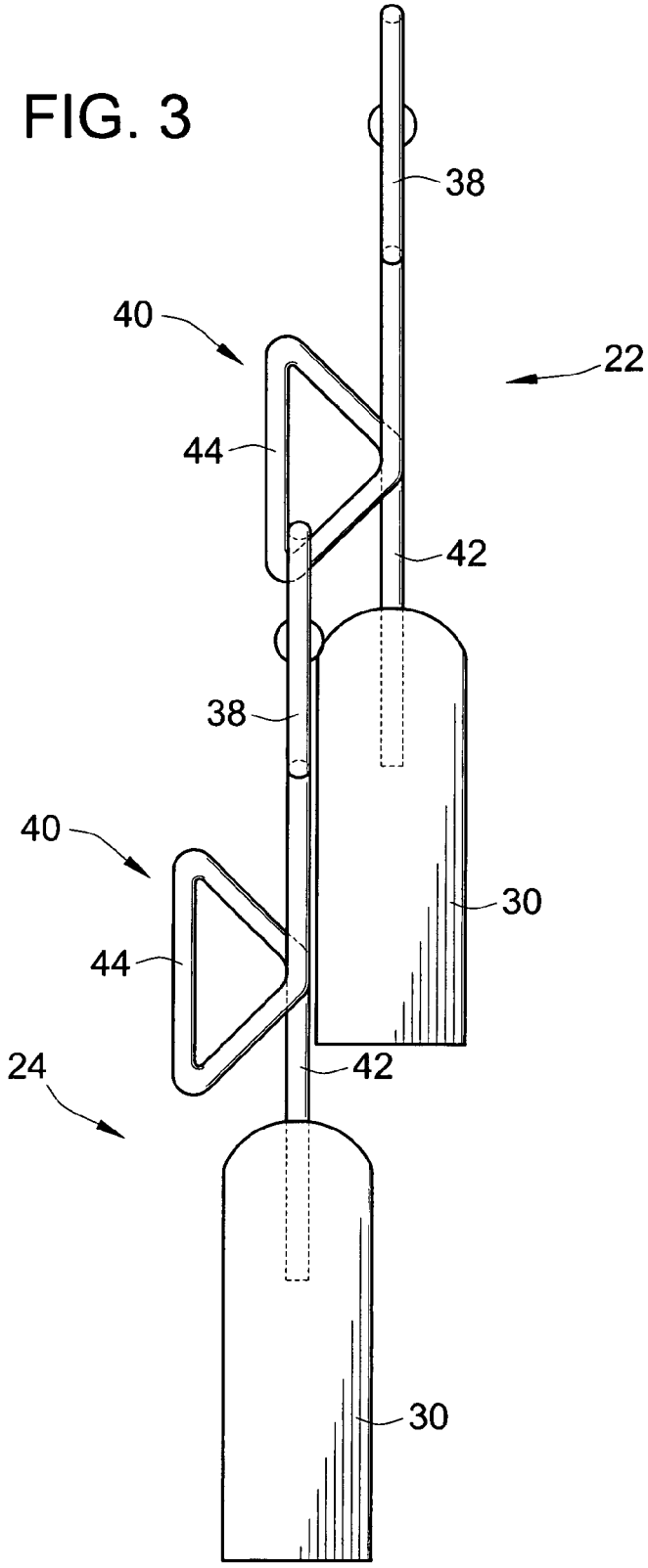
FIG. 3 depicts the hanger assembly of FIG. 1 in a stack.

The hook member 36 includes a hook section 38, a loop section 40, and a mount section 42. The loop surface is generally approximately perpendicular to the hook section 38. In the embodiment shown, the loop section 40 is triangular shaped. The hook section 38 is for attaching the hanger to a rod or other support, including a triangular shaped section of another hanger as illustrated in FIG. 3. While FIG. 3 shows a hanger 24 with a triangular shaped section hooked in a triangular section of hanger 22, it will be recognized that any type of hanger can be put within the triangular shaped section 40 of hanger 22. The mount section 42 is attached to the hanger via conventional means. The loop section 40 can be formed in different sizes and shapes. The loop section is typically formed into a closed shape, although it may have a slight opening to allow hangers to slide through the opening. As used herein, the term "substantially closed" refers to both "closed" loop shapes and loop shapes that have a slight opening. The size in one embodiment is dependent on the thickness of the hanger frame. For example, the triangular shaped section 40 of the hanger of FIG. 3 is sized such that the distance of the outermost section 44 of section 40 from the mount section 42 is longer than the width of the frame 30.

Figure 1B:
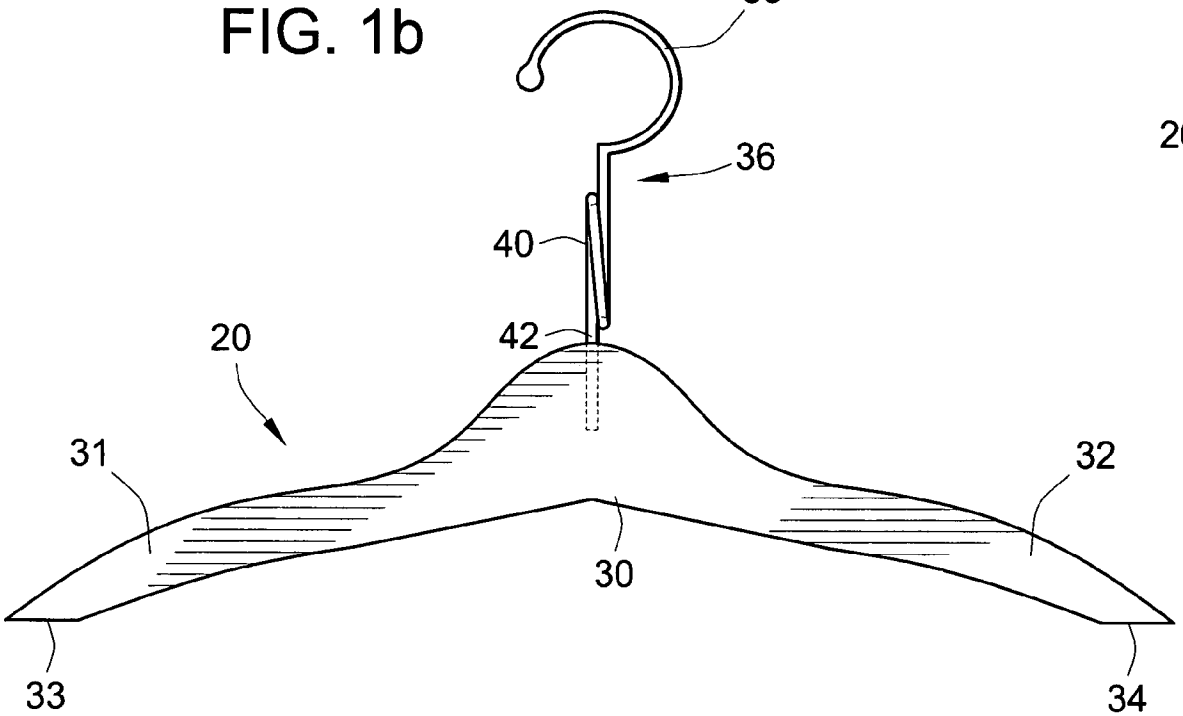
Figure 1C:
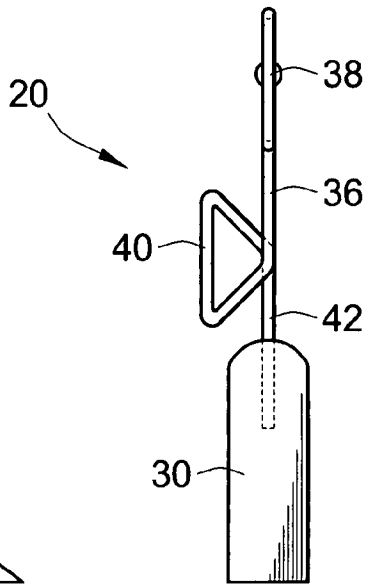
Figure 2A:
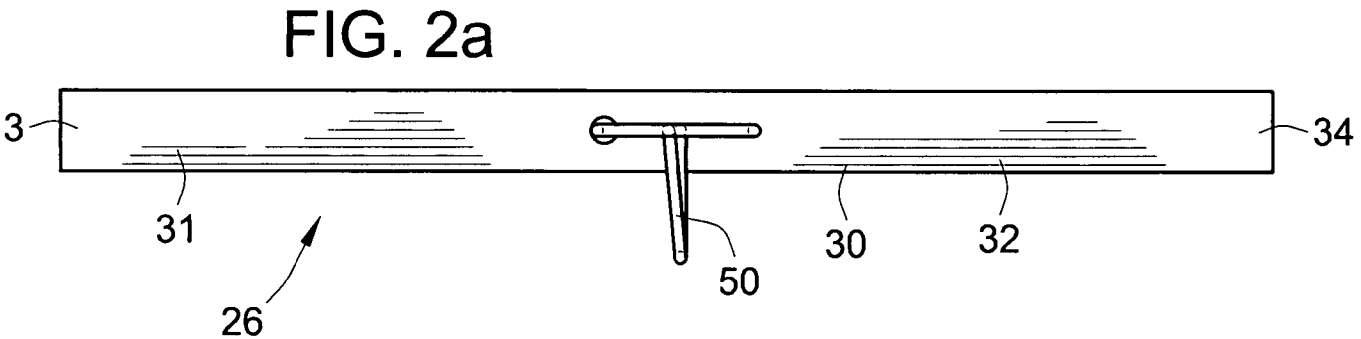
FIGS. 2*a*, 2*b* and 2*c* depict front, top and cross-sectional views of an alternate embodiment of the hanger assembly constructed in accordance with the teachings of the present invention.
Figure 2B:
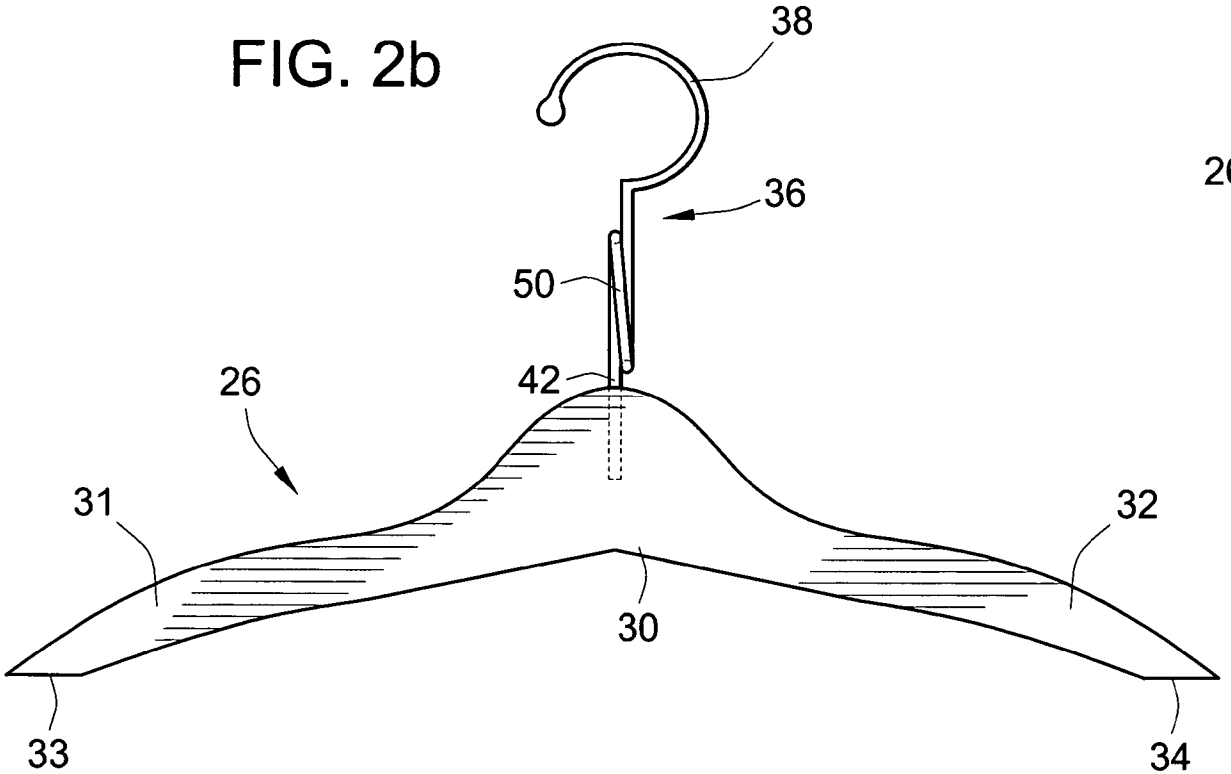
Figure 2C:
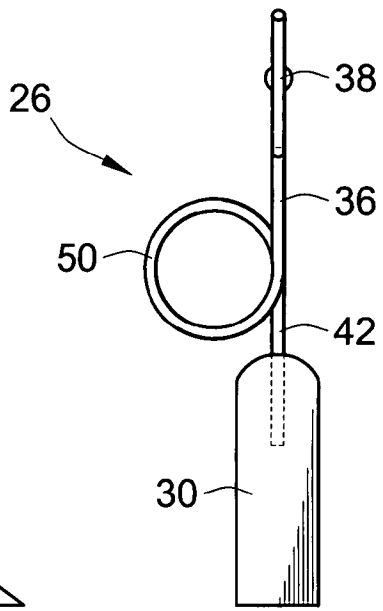
Figure 4C:
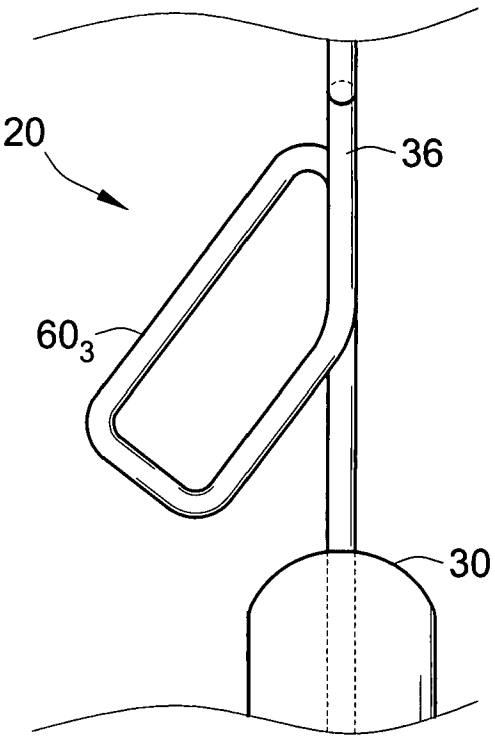
FIGS. 4*a*–4*h* depict cross-sectional views of alternate embodiments of the hanger assembly in accordance with the teachings of the present invention.
Figure 4B:
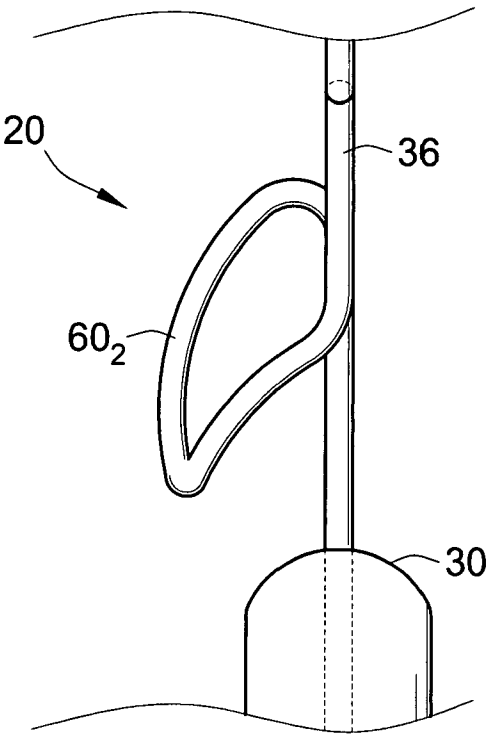
Figure 4A:
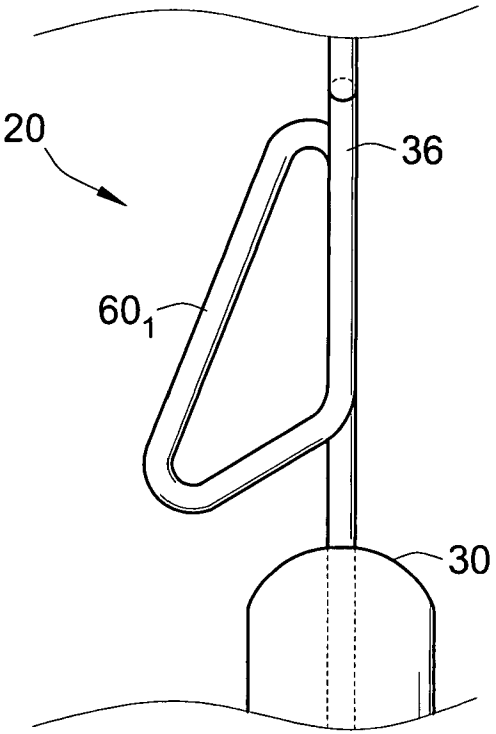
Figure 4F:
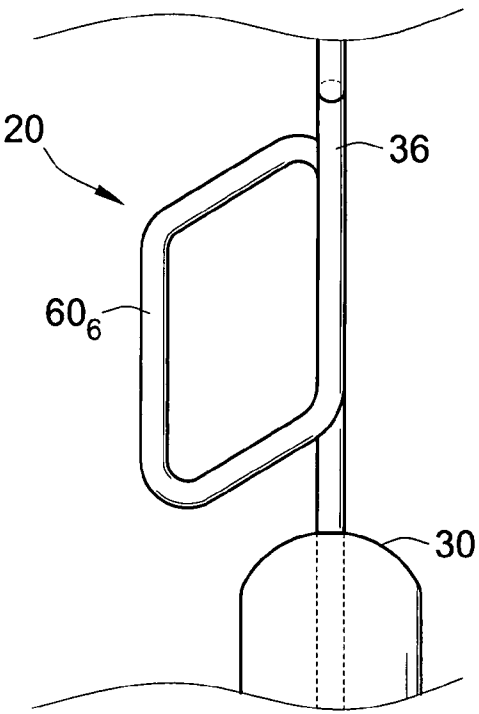
Figure 4E:
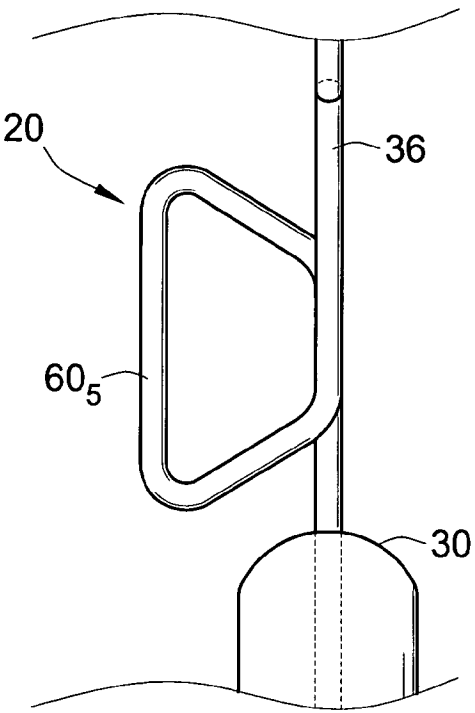
Figure 4D:
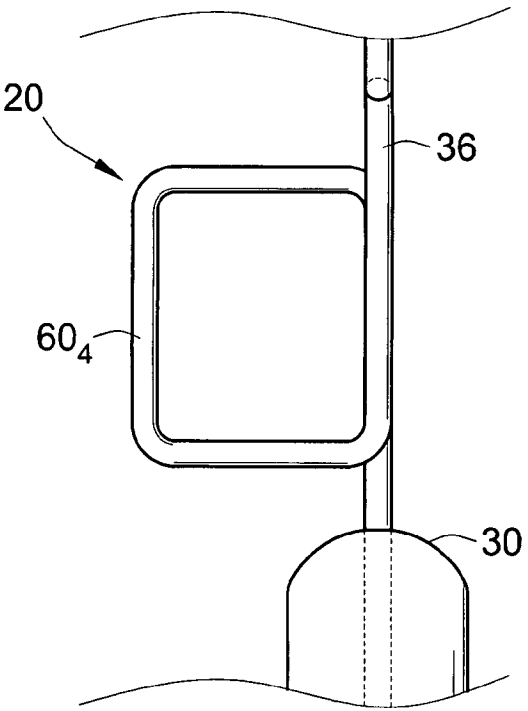
Figure 4H:
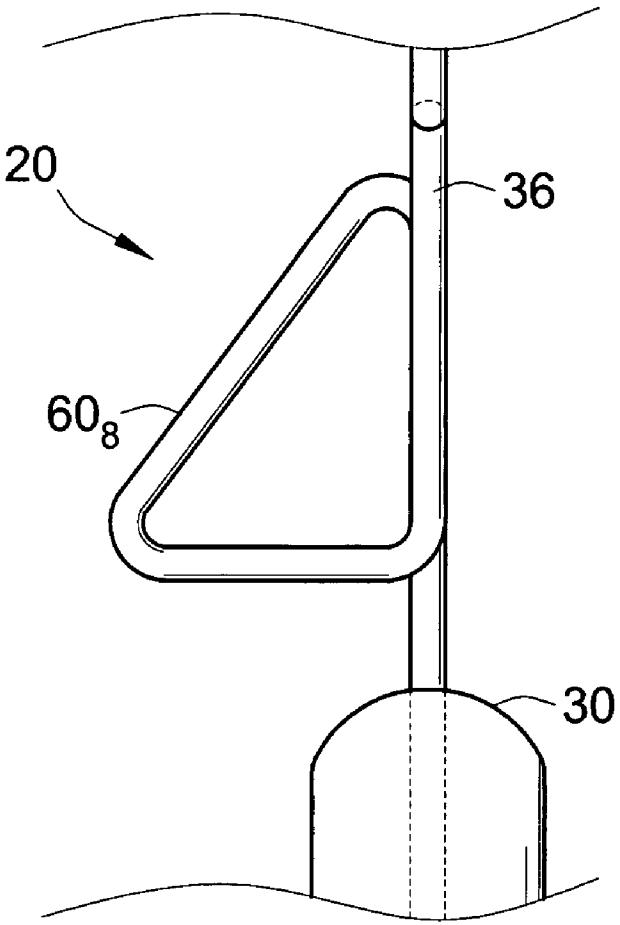
Figure 4G:
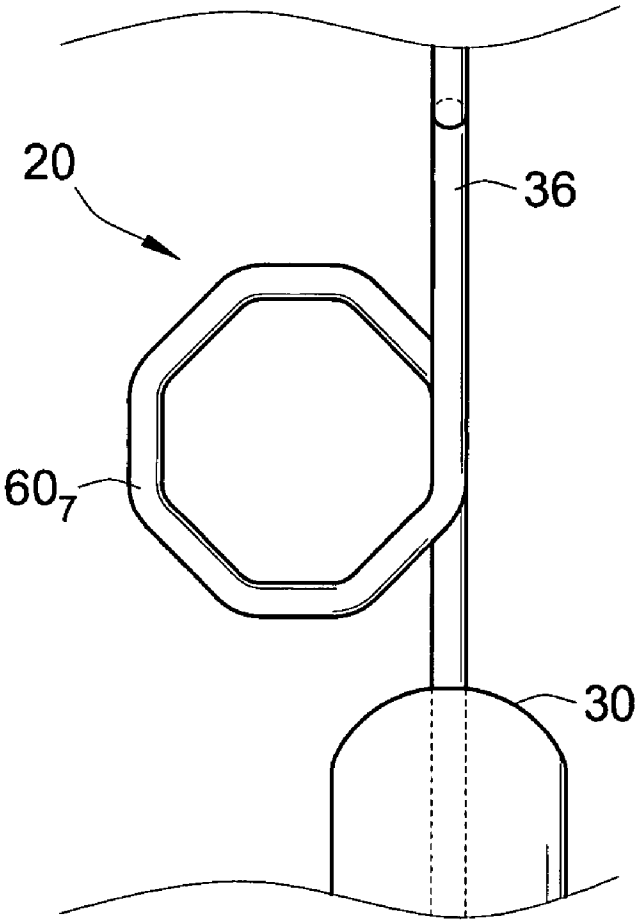

While FIGS. 1*a*–1*c* illustrate a triangular shaped loop section, it is recognized that other shapes may be used such as circular, rectangular, trapezoidal, etc. For example, FIGS. 2*a*–2*c* illustrate a hanger 26 having a circular shaped section 50. The size of the circular shaped section 50 can vary from a small circle that a single hanger fits within the circle or a larger circle where a plurality of hangers can fit within the circle. FIGS. 4*a*–4*h* illustrate other shapes of the loop section. FIG. 4*a* shows an alternative triangular shaped section $\mathbf{60}_1$. FIG. 4*b* shows a shark-fin shaped section $\mathbf{60}_2$. FIG. 4*c* shows a rectangular shaped section $\mathbf{60}_3$. FIG. 4*d* shows a square shaped section $\mathbf{60}_4$. FIG. 4*e* shows a trapezoid shaped section $\mathbf{60}_5$. FIG. 4*f* shows a parallelogram shaped section $\mathbf{60}_6$. FIG. 4*g* shows an octagon shaped section $\mathbf{60}_7$. FIG. 4*h* shows a right triangular shaped section $\mathbf{60}_8$. Other shapes include polygons, quadrilaterals, rhombus, pentagon, hexagon, heptagon, nonagon, decagons, and the like.

Figure 6:
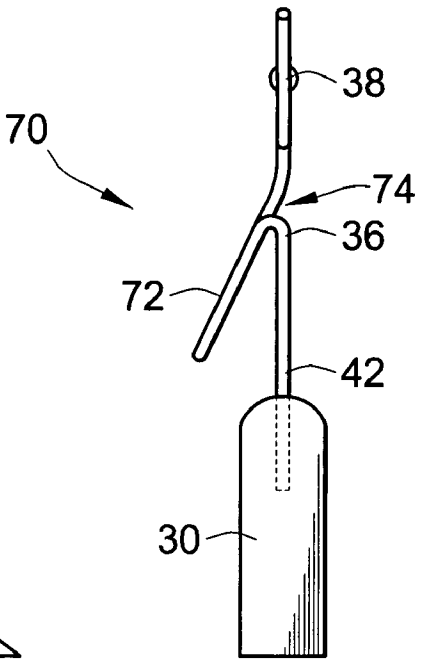
FIG. 6 illustrates a side view of the hanger assembly of FIG. 5.
Figure 5:
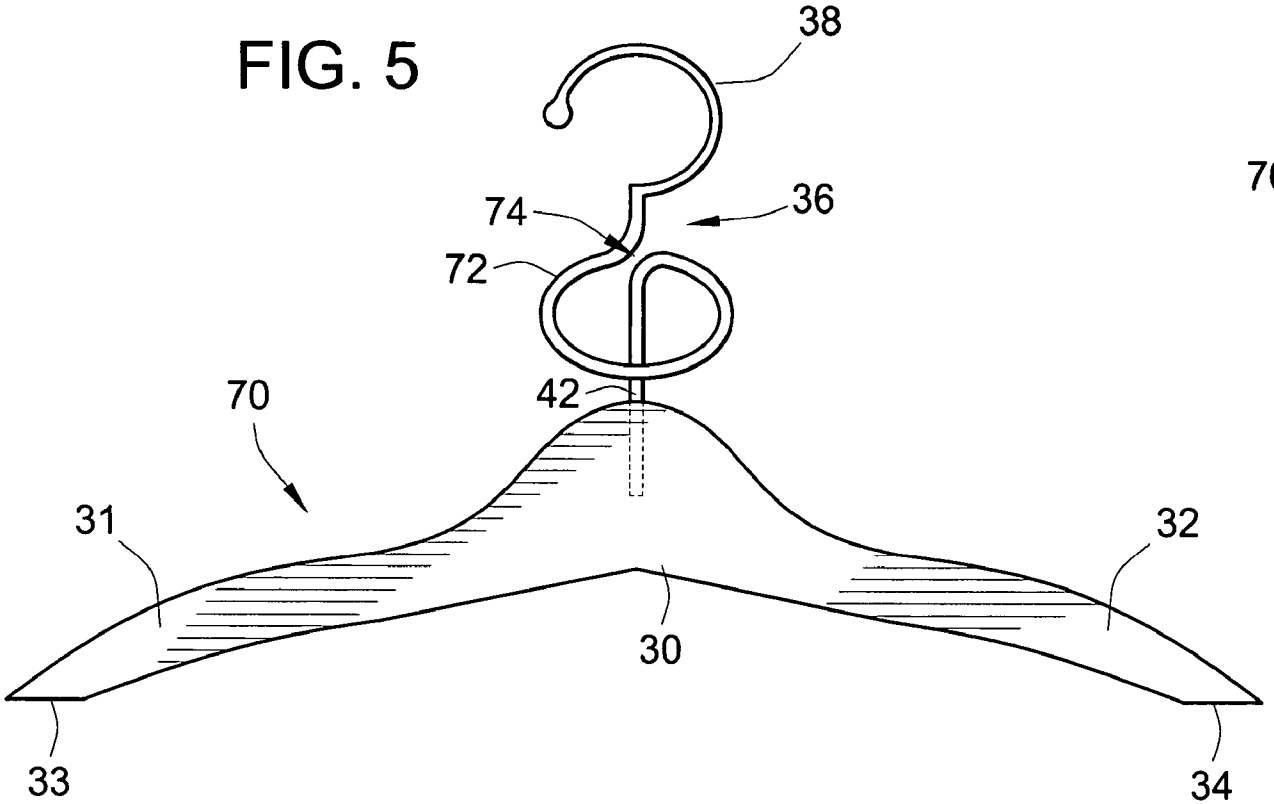
FIG. 5 illustrates another embodiment of the hanger assembly that has an open circular shape in accordance with the teachings of the present invention.
Figure 7:
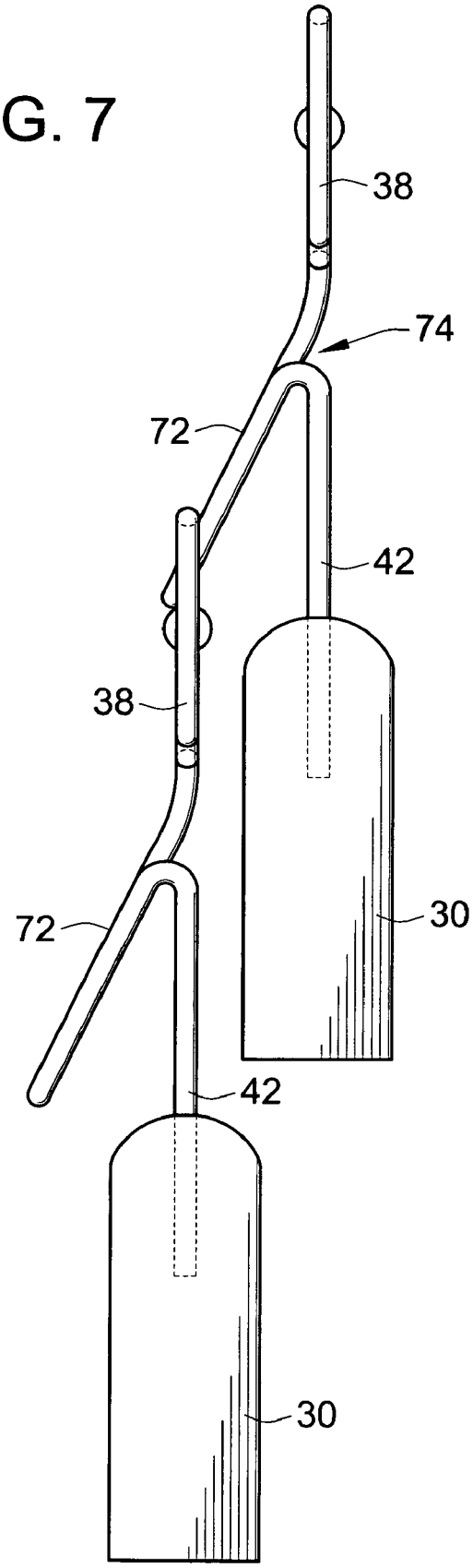
FIG. 7 illustrates the hanger assembly of FIG. 5 in a stack.
Figure 8A:
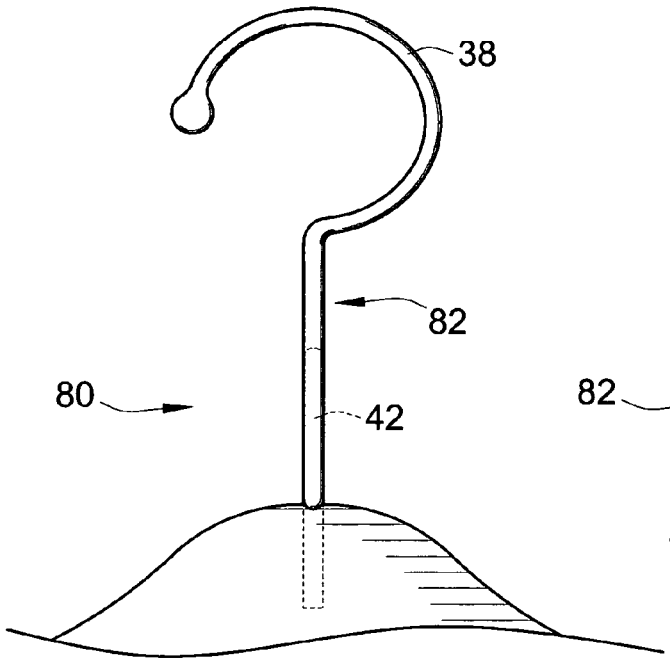
FIG. 8*a* illustrates a further embodiment of the hanger assembly that has an open loop.
Figure 8B:
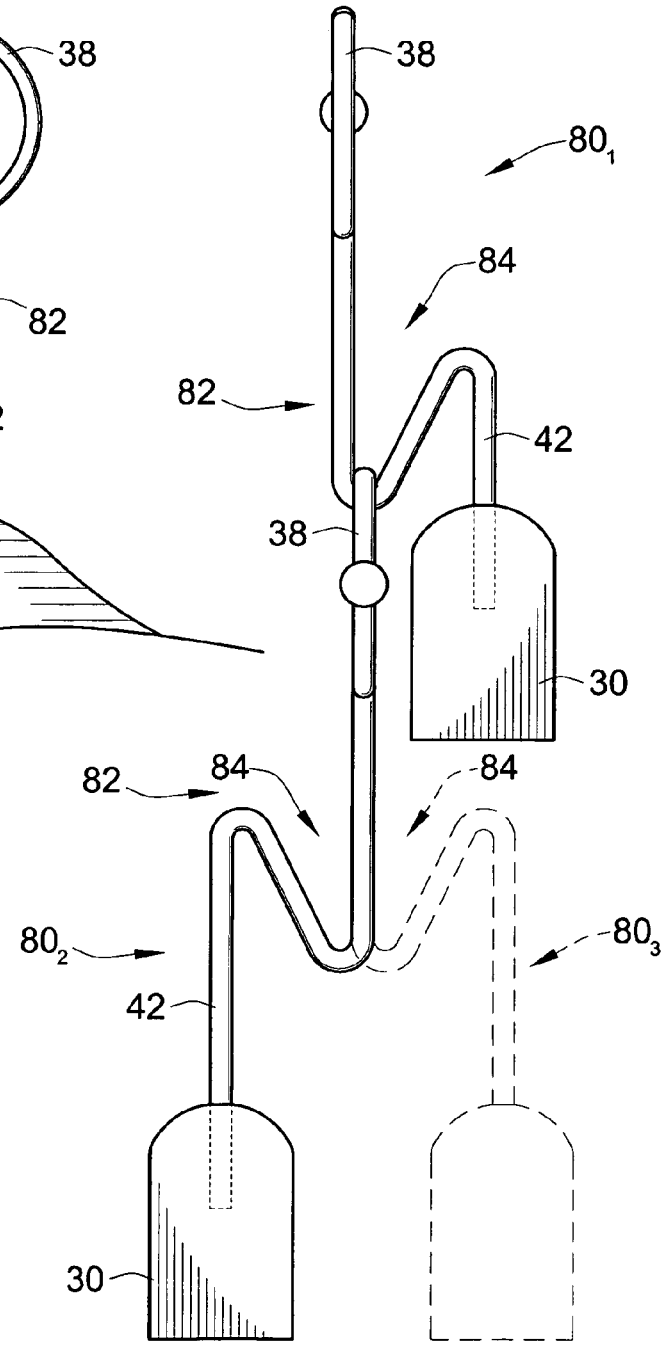
FIG. 8*b* illustrates a side view of the hanger assembly of FIG. 8*a* in a stack.

As previously stated, the loop section may have an opening to allow hangers to slide into the loop. This is illustrated in FIGS. 5 to 8*b*. FIGS. 5 and 6 show a hanger 70 with a circular loop section 72 that has an opening 74. FIG. 7 illustrates hangers 70 being stacked. FIGS. 8*a* and 8*b* illustrate hanger 80 having a loop section 82 within opening 84. The hanger 80 is stackable in two ways. The first way is such that the hangers 80 stack apart from each other as shown by hangers $\mathbf{80}_1$ and $\mathbf{80}_2$ (see FIG. 8*b*). The second way is shown in dashed lines where the hangers stack on top of each other as shown by the dashed outline of hanger $\mathbf{80}_3$ beneath hanger $\mathbf{80}_1$.

Accordingly, it can be seen that the hook member with the loop shaped section (e.g., triangular shape and circular shaped, etc.) allows hangers to be stacked. The shapes allow one or more hangers to be placed within the shape without catching clothes when the hangers are removed from the shaped sections. Alternatively, hangers can be placed on top of the shape, which also allows one or more hangers to be held.

In these respects, the garment hanger with the shaped section in the hook member substantially departs from the conventional concepts and designs of the prior art, and therefore provides an apparatus primarily developed for the purpose of permitting hangers to be stacked on top of each other based on a user's available space.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A garment hanger comprising:

a frame having a plurality of arms projecting outwardly from a center of the frame; and a hook member comprising:

a mount section attached to the center of the frame, a substantially closed loop section attached to the mount section and extending upwardly from the frame, and a hook section attached to the loop section, wherein the substantially closed loop section is in a plane perpendicular to a plane containing the hook section, wherein the mount section, the substantially closed loop section, and the hook section are formed from one continuous piece of wire, and wherein the loop section is sized such that a hook section of at least one other hanger may be placed in the loop section without catching articles hung on the garment hanger.

2. The garment hanger of claim 1 wherein the loop section has a portion furthest away from the mount section and the distance between the portion and the mount section is at least a distance that is one half the thickness of the frame.

3. The garment hanger of claim 1 wherein the substantially closed loop section has a triangular shape.

4. The garment hanger of claim 3 wherein each side of the triangular shape has an equal length.

5. The garment hanger of claim 3 wherein each side of the triangular shape has an unequal length with respect to other sides of the triangular shape.

6. The garment hanger of claim 1 wherein the substantially closed loop section has a circular shape.

7. The garment hanger of claim 1 wherein the substantially closed loop section has an octagon shape.

8. The garment hanger of claim 1 wherein the substantially closed loop section has a shark-fin shape.

9. The garment hanger of claim 1 wherein the substantially closed loop section has a square shape.

10. The garment hanger of claim 1 wherein the substantially closed loop section has a trapezoid shape.

11. The garment hanger of claim 1 wherein the substantially closed loop section has a parallelogram shape.

12. The garment hanger of claim 1 wherein the substantially closed loop section has a right triangle shape.

13. The garment hanger of claim 1 wherein the substantially closed loop section has a polygon shape.

14. The garment hanger of claim 1 wherein the hook member is formed from a continuous piece of material.

15. The garment hanger of claim 1 wherein the frame comprises one of a wood frame and a plastic frame.

16. A garment hanger comprising: a frame having a plurality of arms projecting outwardly from a center of the frame; and a hook member comprising:

a mount section attached to the center of the frame, a substantially closed loop section attached to the mount section and extending upwardly from the frame, and a hook section attached to the loop section, wherein the substantially closed loop section is in a plane perpendicular to a plane containing the hook section, wherein the mount section, the substantially closed loop section, and the hook section are formed from one continuous piece of wire, and wherein the loop section is sized such that a hook section of at least one another hanger may be placed in the loop section without catching articles hung on the garment hanger, and wherein the loop section has a portion furthest away from the mount section such that the distance between the portion and the mount section is at least a distance that is one half the thickness of the frame.

17. The garment hanger of claim 16 wherein the substantially closed loop section has a triangular shape and wherein each side of the triangular shape has one of equal length with respect to each other and an unequal length with respect to other sides of the triangular shape.

18. The garment hanger of claim 16 wherein the substantially closed loop section has a circular shape.

19. The garment hanger of claim 16 wherein the substantially closed loop section has one of an octagon shape, a square shape, and a trapezoid shape.

20. The garment hanger of claim 16 wherein the substantially closed loop section has a shark-fin shape.

21. The garment hanger of claim 16 wherein the substantially closed loop section has a parallelogram shape.

22. The garment hanger of claim 16 wherein the substantially closed loop section has a polygon shape.

23. The garment hanger of claim 16 wherein the substantially closed loop section has a shape that allows an other garment hanger to be hung from the garment hanger such that the other garment hanger's frame is below the garment hanger's frame.

* * * * *